US005529710A

United States Patent [19]

Van Dijk et al.

[11] Patent Number: 5,529,710

[45] Date of Patent: Jun. 25, 1996

[54] PRODUCTION OF DETERGENT GRANULES WITH EXCELLENT WHITE APPEARANCE

[75] Inventors: Paul Van Dijk, Putte; Jose L. Vega, Strombeek-Bever; Benny De Ryck, Putte, all of Belgium

[73] Assignee: The Procter & Gamble Company, Cincinnati, Ohio

[21] Appl. No.: 367,289

[22] PCT Filed: Jun. 18, 1993

[86] PCT No.: PCT/US93/05888

§ 371 Date: Jan. 13, 1995

§ 102(e) Date: Jan. 13, 1995

[87] PCT Pub. No.: WO94/02574

PCT Pub. Date: Feb. 3, 1994

[30] Foreign Application Priority Data

Jul. 15, 1992 [EP] European Pat. Off. ..... 92202170

[51] Int. Cl.[6] ..... C11D 1/12; C11D 11/00; C11D 17/06

[52] U.S. Cl. ..... 252/89.1; 252/174; 252/543; 252/549; 264/117; 264/140

[58] Field of Search ..... 252/89.1, 174, 252/543, 549; 264/117, 140

[56] References Cited

U.S. PATENT DOCUMENTS

| | | | |
|---|---|---|---|
| 2,930,760 | 3/1960 | Gebhardt | 252/110 |
| 3,627,822 | 12/1971 | Sundby | 260/513 |
| 3,931,037 | 1/1976 | Hall | 252/135 |
| 3,986,987 | 10/1976 | D'Souza | 252/527 |
| 4,082,682 | 4/1978 | Inamorato et al. | 252/92 |
| 4,097,418 | 6/1978 | Rolfes | 252/531 |
| 4,179,391 | 12/1979 | Kaufmann et al. | 252/99 |
| 4,263,176 | 4/1981 | Martin et al. | 252/543 |
| 4,919,847 | 4/1990 | Barletta et al. | 252/558 |
| 5,080,848 | 1/1992 | Strauss et al. | 264/117 |
| 5,164,108 | 11/1992 | Appel et al. | 252/174 |
| 5,244,593 | 9/1993 | Roselle et al. | 252/99 |
| 5,451,354 | 4/1994 | Aouad et al. | 264/117 |

*Primary Examiner*—Paul Lieberman
*Assistant Examiner*—Lorna M. Douyon
*Attorney, Agent, or Firm*—Ken K. Patel; Jacobus C. Rasser; Jerry J. Yetter

[57] ABSTRACT

A high active detergent paste composition which is suitable for making detergent granules which have an excellent white appearance making them suitable for use in consumer products. The paste compositions comprise a dye or optical brightener.

8 Claims, No Drawings

PRODUCTION OF DETERGENT GRANULES WITH EXCELLENT WHITE APPEARANCE

FIELD OF THE INVENTION

Currently there is a trend towards compact detergents which offer the consumer a product which is more convenient to carry and store, as well as reducing the weight of packaging materials used. In order to manufacture these compact detergents, there is a need to use high density, high activity granules/agglomerates.

One problem which is associated with such high activity particles is the discoloration of the organic surfactant material. Such discoloration is highly undesirable in a finished detergent product and can cause detergent granules made from a paste of anionic detergent salts to be yellow in colour which is unacceptable to the consumer and therefore not commercially viable. This problem is particularly acute in granules which have a high activity of organic surfactant.

One way of making high active detergent granules is by agglomeration of high active pastes consisting of the salts of anionic surfactants with detergent powders. Such pastes have rarely been handled before in the detergent industry for various reasons, including the practical difficulties in handling high viscosity pastes and the need to maintain high temperatures in order to prevent solidification of the material, and the problems associated with discoloration.

There is a need, for a consumer acceptance point-of-view, to make high active detergent granules which have a white, or near-white appearance. According to Herman de Groot, W. "Sulphonation Technology in the Detergent Industry", Kluwer Academic Publishers, 1991, a common approach to improving colour is by bleaching of dark, organic compounds, especially anionic surfactants like linear alkyl benzene sulphonate (LAS) or methyl ester sulphonate (MES). Bleaching is achieved by an agent which disrupts the conjugated carbon double bonds, either by reaction with one of the conjugated double bonds or by oxidation and/or reduction of the chromophore. There is a variety of bleaching agents potentially available for this purpose but only sodium hypochlorite and hydrogen peroxide have commercial importance. Sodium hypochlorite is a more convenient and efficient bleach than hydrogen peroxide. However, chlorine-based bleach may be undesirable due to the potential to generate sensitisers during the process of some feedstocks. As an alternative, hydrogen peroxide may be used, but is less cost-efficient and can cause process control difficulties due to excessive foaming caused by the liberation of oxygen during bleaching.

GB 1 369 269, published on Oct.2nd, 1974, describes a process of dry neutralisation for making detergent granules. It says that various difficulties are encountered including local discoloration of the organic detergent. However no solutions are specifically given to this problem.

GB 2 221 695, published on Feb. 14th, 1990, also describes a dry neutralisation process. It says that various adjuvants may be added with the neutralising agent, but there are no benefits suggested from adding brighteners or dyes, apart from it being a convenient process route for many adjuvants.

GB 2 166 452, published on May 8th, 1986, describes a processing route which involves dispersing organic materials with particles of an inorganic component to form solid pellets which may then be granulated. A wide choice of detergent ingredients which may be added upon neutralisation is suggested, including, blueing agents, fluorescent dyes and pigments. However, once again, there is no suggestion of any particular benefit to be gained from choosing these ingredients.

EPA 327 963, published on Aug. 16th, 1989 discloses a method of pre-neutralising the surfactant acids in a slurry, spray-drying the slurry to form a powder and densifying said powder. Brighteners may be incorporated into the slurry as a convenient way of bringing them into the finished composition, but there is no suggestion that this is of benefit to the colour of the densified granules.

Co-pending European Applications 92870026.9, 92200994.9 and 92200993.1, form part of the prior art under Art 54(3) EPC. These applications disclose detergent compositions, and processes for making such compositions from high active detergent pastes. The addition of an optical brightener in the finished detergent composition is disclosed but there is no mention of using dyes or optical brightener in the high active detergent pastes to avoid the discolouration problem, nor is the addition of dyes or brighteners into the high shear mixer disclosed. These new processes, based on high active detergent pastes, enable manufacture of granules having a higher surfactant activity than before, which may lead to the discoloration problems caused by feedstocks in the form of hot surfactant pastes.

It is an aim of the present invention to provide a composition of a high active paste of detergent salts which comprises specific ingredients which give a very acceptable white appearance to the finished detergent granules.

It is a further aim of the present invention to provide a process for making a concentrated detergent powder which combines high activity, high bulk density and consumer acceptable colour.

SUMMARY OF THE INVENTION

A high active detergent paste composition which comprises at least 40% by weight of the composition of the salts of anionic surface active agents, said composition having a viscosity of at least 10 Pa.s when measured at a temperature of 70° C. and a shear rate of $25s^{-1}$, further comprises a dye or an optical brightener, or a mixture thereof.

DETAILED DESCRIPTION OF THE INVENTION

It has been found that the incorporation of certain dyes and optical brighteners into granules made by an agglomeration process can give very good colour to the detergent granule when fresh, and colour characteristics which are maintained, or even improve upon storage.

The dye or optical brightener is preferably added to the composition either before or during the agglomeration process, preferably in a liquid form. A preferred embodiment of this invention is to use either an aqueous solution or in an organic carrier medium. In a most preferred embodiment the organic carrier is a nonionic surfactant or polyethylene glycol.

MANUFACTURE OF HIGH ACTIVE DETERGENT GRANULES

The granules of the present invention are made by mixing a high active paste comprising the salts of anionic surfactants with detergent powders in a high shear mixer (agglomerator). The effect of the mixer is firstly to fluidise the powder and then to rapidly disperse the surfactant paste into this fluidised powder. The resulting mixture remains in substantially discrete particles at all time. It is not allowed to form into a dough which would cause the high shear mixer to block. Inside the mixer a fine dispersion mixing and granulation process takes place under the influence of cutting and mixing tools mounted on a shaft. Suitable paste compositions and processes are described in more detail hereinbelow. The resulting particles are high in surfactant activity and high in bulk density, but still have good flow and non-caking characteristics. Preferably the surfactant activity is greater than 40% by weight of the particles, and the bulk density is at least 600 g/1.

The dye or optical brightener, when it is in a liquid form may be either premixed with the high active detergent paste by means of a batch mix tank or continuously into an extruder or into a neutralisation loop, or it may be sprayed or pumped directly into the high shear mixer where it will be dispersed into the particles formed therein. In a particularly preferred process, the dye or optical brightener is pumped directly into the neutralisation loop in which the acid forms of the surfactant are being neutralised.

SUITABLE DYES AND OPTICAL BRIGHTENERS

Suitable dyes and optical brighteners for the present invention are those that emit light in the violet or blue range of the spectrum. For the present invention, it is preferred that the light emitted by these dyes lies mostly (at least 70%) in the region of visible light below 500 nm wavelength. Examples of useful dyes include Levanyl Violet BNZ (Trade Name) and Special Fast Blue G FW Ground (Trade Name), both supplied by Bayer AG. The Levanyl/Violet BNZ Dye is characterized by a Part I Color Index classification of Pigment Violet 23, and a Part II Color Index classification of 51319. The Special Fast Blue G FW dye is characterized by a Part I Color Index classification of Acid Blue 127/1.

Preferred optical brighteners are chosen from the sodium salts of:

4,4'-bis-(2-diethanolamino-4-anilino-s-triazin-6-ylamino) stilbene-2:2' disulphonate 4,4'-bis-(2-morpholino-4-anilino-s-triazin-6-ylamino) stilbene-2:2' disulphonate 4,4'-bis-(2,4-dianilino-s-triazin-6-ylamino) stilbene-2:2' disulphonate 4',4"-bis-(2,4-dianilino-s-triazin-6-ylamino) stilbene-2-sulphonate 4,4'-bis-(2-anilino-4-(N-methyl N-2-hydroxyethylamino)-s-triazin- 6-ylamino) stilbene-2,2' disulphonate 4,4'-bis-(4-phenyl-2,1,3-triazol-2-yl) stilbene-2,2' disulphonate 4,4'-bis-(2-anilino-4-(1-methyl-2-hydroxyethylamino)-s-triazin- 6-ylamino) stilbene-2,2' disulphonate 4,4-bis (2-sulphostyryl) biphenyl 4,4-bis (4-chloro-3-sulphostyryl) biphenyl Other optical brighteners which are also preferred for use in the present invention include the derivatives of bis-benzoxazolyl and 1-3-diphenyl-2-pyrazoline.

The levels of dyes used in the detergent paste is less than 20 ppm, preferably from 0.1 to 20 ppm. (These levels are referred to as parts per million of pure dye, although normally such dyes are supplied as solutions).

The level of optical brightener in the surfactant paste is generally less than 5% and preferably less than 2%. The level of optical brightener in the granular detergent component or composition is typically less than 2%, preferably less than 1%.

The Pastes

One or various aqueous pastes of the salts of anionic surfactants is preferred for use in the present invention, preferably the sodium salt of the anionic surfactant. In a preferred embodiment, the anionic surfactant is preferably as concentrated as possible, (that is, with the lowest possible moisture content possible that allows it to flow in the manner of a liquid) so that it can be pumped at temperatures at which it remains stable. While granulation using various pure or mixed surfactants is known, for the present invention to be of practical use in industry and to result in particles of adequate physical properties to be incorporated into granular detergents, an anionic surfactant must be part of the paste in a concentration of above 40%, preferably from 40–95%, and most preferably from 60%–95%.

It is preferred that the moisture in the surfactant aqueous paste is as low as possible, while maintaining paste fluidity, since low moisture leads to a higher concentration of the surfactant in the finished particle. Preferably the paste contains between 5 and 40% water, more preferably between 5 and 30% water and most preferably between 5 and 20% water. A highly attractive mode of operation for lowering the moisture of the paste prior to entering the agglomerator without problems with very high viscosities is the installation, in line, of an atmospheric or a vacuum flash drier whose outlet is connected to the agglomerator.

It is preferable to use high active surfactant pastes to minimize the total water level in the system during mixing, granulating and drying. Lower water levels allow for: (1) a higher active surfactant to builder ratio, e.g., 1:1; (2) higher levels of other liquids in the formula without causing dough or granular stickiness; (3) less cooling, due to higher allowable granulation temperatures; and (4) less granular drying to meet final moisture limits.

Two important parameters of the surfactant pastes which can affect the mixing and granulation step are the paste temperature and viscosity. Viscosity is a function, among others, of concentration and temperature, with a range in this application from about 10 Pa.s to 10,000 Pa.s. Preferably, the viscosity of the paste entering the system is from about 20 to about 100 Pa.s. and more preferably from about 30 to about 70 Pa.s. The viscosity of the paste of this invention is measured at a temperature of 70° C. and at a shear rate of $25s^{-1}$.

The paste can be introduced into the mixer at an initial temperature between its softening point (generally in the range of 40°–60° C.) and its degradation point (depending on the chemical nature of the paste, e.g. alkyl sulphate pastes tend to degrade above 75°–85° C.). High temperatures reduce viscosity simplifying the pumping of the paste but result in lower active agglomerates. The use of in-line moisture reduction steps (e.g. flash drying), however, require the use of higher temperatures (above 100° C.). In the present invention, the activity of the agglomerates is maintained high due to the elimination of moisture.

The introduction of the paste into the mixer can be done in many ways, from simply pouring to high pressure pumping through small holes at the end of the pipe, before the entrance to the mixer. While all these ways are viable to manufacture agglomerates with good physical properties, it has been found that in a preferred embodiment of the present invention the extrusion of the paste results in a better distribution in the mixer which improves the yield of particles with the desired size. The use of high pumping pressures prior to the entrance in the mixer results in an increased activity in the final agglomerates. By combining both effects, and introducing the paste through holes (extrusion) small enough to allow the desired flow rate but that keep the pumping pressure to a maximum feasible in the system, highly advantageous results are achieved.

High Active Surfactant Paste

The activity of the aqueous surfactant paste is at least 40% and can go up to about 95%; preferred activities are: 60–95% and 65–80%. The balance of the paste is primarily water but can include various processing aids. At the higher active concentrations, little or no builder is required for cold granulation of the paste. The resultant concentrated surfactant granules can be added to dry builders or powders or used in conventional agglomeration operations. The aqueous surfactant paste contains an organic surfactant selected from the group consisting of anionic, zwitterionic, ampholytic and cationic surfactants, and mixtures thereof. Anionic surfactants are preferred. Nonionic surfactants are used as secondary surfactants or processing aids, or as the organic carrier for the optical brightener, and are not included herein as an "active" surfactant. Surfactants useful herein are listed in U.S. Pat. No. 3,664,961, Norris, issued May 23, 1972, and in U.S. Pat. No. 3,919,678, Laughlin et al., issued Dec. 30, 1975. Useful cationic surfactants also include those described in U.S. Pat. No. 4,222,905, Cockrell, issued Sep. 16, 1980, and in U.S. Pat. 4,239,659, Murphy, issued Dec. 16, 1980. However, cationic surfactants are generally less compatible with the aluminosilicate materials herein, and thus are preferably used at low levels, if at all, in the present compositions. The following are representative examples of surfactants useful in the present compositions.

Water-soluble salts of the higher fatty acids, i.e., "soaps", are useful anionic surfactants in the compositions herein. This includes alkali metal soaps such as the sodium, potassium, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkyl benzene sulfonates in which the alkyl group contains from about 9 to about 15 carbon atoms, in straight or branched chain configuration, e.g., those of the type described in U.S. Pat. Nos. 2,220,099 and 2,477,383. Especially valuable are linear straight chain alkyl benzene sulfonates in which the average number of carbon atoms in the alkyl group is from about 11 to 13, abbreviated as $C_{11}$–$C_{13}$ LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing from about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; watersoluble salts of olefin sulfonates containing from about 12 to 24 carbon atoms; and beta-alkyloxy alkane sulfonates containing from about 1 to 3 carbon atoms in the alkyl group and from about 8 to about 20 carbon atoms in the alkane moiety. Although the acid salts are typically discussed and used, the acid neutralization can be performed as part of the fine dispersion mixing step.

The present invention has been found to be particularly useful when the anionic surfactant paste comprises surfactants which are particularly vulnerable to discoloration, such as those pastes comprising at least 5% by weight of linear alkyl benzene sulphonate, methyl ester sulphonate or paraffin sulphonate, or a mixture of these.

The preferred anionic surfactant pastes are mixtures of linear or branched alkylbenzene sulfonates having an alkyl of 10–16 carbon atoms and alkyl sulfates having an alkyl of 10–18 carbon atoms. These pastes are usually produced by reacting a liquid organic material with sulfur trioxide to produce a sulfonic or sulfuric acid and then neutralizing the acid to produce a salt of that acid. The salt is the surfactant paste discussed throughout this document. The sodium salt is preferred due to end performance benefits and cost of NaOH vs. other neutralizing agents, but is not required as other agents such as KOH may be used.

Water-soluble nonionic surfactants are also useful as secondary surfactant in the compositions of the invention. Indeed, preferred processes use anionic/nonionic blends. A particularly preferred paste comprises a blend of nonionic and anionic surfactants having a ratio of from about 0.01:1 to about 1:1, more preferably about 0.05:1. Nonionics can be used up to an equal amount of the primary organic surfactant. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol and alkyl glucose amides.

Preferred nonionics are the water-soluble condensation products of aliphatic alcohols containing from 8 to 22 carbon atoms, in either straight chain or branched configuration, with from 4 to 100 moles of ethylene oxide per mole of alcohol. Particularly preferred are the condensation products of alcohols having an alkyl group containing from about 9 to 15 carbon atoms with from about 4 to 80 moles of ethylene oxide per mole of alcohol; and condensation products of propylene glycol with ethylene oxide.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be either straight or branched chain and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium phosphonium, and sulfonium compounds in which one of the aliphatic substituents contains from about 8 to 18 carbon atoms.

Particularly preferred surfactants herein include linear alkylbenzene sulfonates containing from about 11 to 14 carbon atoms in the alkyl group; tallow alkyl sulfates; coconutalkyl glyceryl ether sulfonates; alkyl ether sulfates wherein the alkyl moiety contains from about 14 to 18 carbon atoms and wherein the average degree of ethoxylation is from about 1 to 4; olefin or paraffin sulfonates containing from about 14 to 16 carbon atoms; alkyldimethylamine oxides wherein the alkyl group contains from about 11 to 16 carbon atoms; alkyldimethylammonio propane sulfonates and alkyldimethylammonio hydroxy propane sulfonates wherein the alkyl group contains from about 14 to 18 carbon atoms; soaps of higher fatty acids containing from about 12 to 18 carbon atoms; condensation products of C9-C15 alcohols with from about 3 to 8 moles of ethylene oxide, and mixtures thereof.

Useful cationic surfactants include water-soluble quaternary ammonium compounds of the form $R_4R_5R_6R_7N^+X^-$, wherein $R_4$ is alkyl having from 10 to 20, preferably from 12–18 carbon atoms, and $R_5$, $R_6$ and $R_7$ are each $C_1$ to $C_7$ alkyl preferably methyl; $X^-$ is an anion, e.g. chloride. Examples of such trimethyl ammonium compounds include $C_{12-14}$ alkyl trimethyl ammonium chloride and cocalkyl trimethyl ammonium methosulfate. Other cationic surfactants including coline esters may be used.

Specific preferred surfactants for use herein include: sodium linear $C_{11}$–$C_{13}$ alkylbenzene sulfonate; alpha-olefin sulphonates; triethanolammonium $C_{11}$–$C_{13}$ alkylbenzene sulfonate; alkyl sulfates, (tallow, coconut, palm, synthetic origins, e.g. $C_{45}$, etc.); sodium alkyl sulfates; methyl ester sulphonate; sodium coconut alkyl glyceryl ether sulfonate; the sodium salt of a sulfated condensation product of a tallow alcohol with about 4 moles of ethylene oxide; the condensation product of a coconut fatty alcohol with about 6 moles of ethylene oxide; the condensation product of tallow fatty alcohol with about 11 moles of ethylene oxide; the condensation of a fatty alcohol containing from about 14 to about 15 carbon atoms with about 7 moles of ethylene oxide; the condensation product of a $C_{12}$–$C_{13}$ fatty alcohol with about 3 moles of ethylene oxide; 3-(N,N-dimethyl-N-coconutalkylammonio)- 2-hydroxypropane-1-sulfonate; 3-(N,N-dimethyl-N-coconutalkylammonio)-propane- 1-sulfonate; 6-(N-dodecylbenzyl-N,N-dimethylammonio) hexanoate; dodecyldimethylamine oxide; coconutalkyldimethylamine oxide; and the water-soluble sodium and potassium salts of coconut and tallow fatty acids.

(As used herein, the term "surfactant" means non-nonionic surfactants, unless otherwise specified. The ratio of the surfactant active (excluding the nonionic(s)) to dry detergent builder or powder ranges from 0.005:1 to 19:1, preferably from 0.05:1 to 10:1, and more preferably from 0.1:1 to 5:1. Even more preferred said surfactant active to builder ratios are 0.15:1 to 1:1; and 0.2:1 to 0.5:1).

Powder Stream

Although the preferred embodiment of the process of the present invention involves introduction of the anionic surfactant in via pastes as described above, it is possible to have a certain amount via the powder stream, for example in the form of blown powder. In these embodiments, it is necessary that the stickiness and moisture of the powder stream be kept at low levels, thus preventing increased "loading" of the anionic surfactant and, thus, the production of agglomerates with too high of a concentration of surfactant. The liquid stream of a preferred agglomeration process can also be used to introduce other surfactants and/or polymers. This can be done by premixing the surfactant into one liquid stream or, alternatively by introducing various streams in the agglomerator. These two process embodiments may produce differences in the properties of the finished particles (dispensing, gelling, rate of dissolution, etc.), particularly, if mixed surfactants are allowed to form prior to particle formation. These differences can then be exploited to the advantage of the intended application for each preferred process.

It has also been observed that by using the presently described technology, it has been possible to incorporate higher levels of certain chemicals (e.g. nonionic, citric acid) in the final formula than via any other known processing route without detrimental effects to some key. properties of the matrix (caking, compression, etc.).

The Fine Dispersion Mixing and Granulation

The term "fine dispersion mixing and/or granulation," as used herein, means mixing and/or granulation of the mixture in a fine dispersion mixer at a blade tip speed of from about 5 m/sec. to about 50 m/sec., unless otherwise specified. The total residence time of the mixing and granulation process is preferably in the order of from 0.1 to 10 minutes, more preferably 0.1–5 and most preferably 0.2–4 minutes. The more preferred mixing and granulation tip speeds are about 10–45 m/sec. and about 15–40 m/sec.

Any apparatus, plants or units suitable for the processing of surfactants can be used for carrying out the process according to the invention. Suitable apparatus includes, for example, falling film sulphonating reactors, digestion tanks, esterification reactors, etc. For mixing/agglomeration any of a number of mixers/agglomerators can be used. In one preferred embodiment, the process of the invention is continuously carried out. Especially preferred are mixers of the Fukae® FS-G series manufactured by Fukae Powtech Kogyo Co., Japan; this apparatus is essentially in the form of a bowl-shaped vessel accessible via a top port, provided near its base with a stirrer having a substantially vertical axis, and a cutter positioned on a side wall. The stirrer and cutter may be operated independently of one another and at separately variable speeds. The vessel can be fitted with a cooling jacket or, if necessary, a cryogenic unit.

Other similar mixers found to be suitable for use in the process of the invention include Diosna®V series ex Dierks & Söhne, Germany; and the Pharma Matrix® ex T K Fielder Ltd., England. Other mixers believed to be suitable for use in the process of the invention are the Fuji® VG-C series ex Fuji Sangyo Co., Japan; and the Roto® ex Zanchetta & Co srl, Italy.

Other preferred suitable equipment can include Eirich®, series RV, manufactured by Gustau Eirich Hardheim, Germany; Lödige®, series FM for batch mixing, series Baud KM for continuous mixing/agglomeration, manufactured by Lödige Machinenbau GmbH, Paderborn Germany; Drais> T160 series, manufactured by Drais Werke GmbH, Mannheim Germany; and Winkworth® RT 25 series, manufactured by Winkworth Machinery Ltd., Berkshire, England.

The Littleford Mixer, Model #FM-130-D-12, with internal chopping blades and the Cuisinart Food Processor, Model #DCX-Plus, with 7.75 inch (19.7 cm) blades are two examples of suitable mixers. Any other mixer with fine dispersion mixing and granulation capability and having a residence time in the order of 0.1 to 10 minutes can be used. The "turbine-type" impeller mixer, having several blades on an axis of rotation, is preferred. The invention can be practiced as a batch or a continuous process.

Operating Temperatures

Preferred operating temperatures should also be as low as possible since this leads to a higher surfactant concentration in the finished particle. Preferably the temperature during the agglomeration is less than 80° C., more preferably between 0° and 70° C., even more preferably between 10° and 60° C. and most preferably between 20° and 50° C. Lower operating temperatures useful in the process of the present invention may be achieved by a variety of methods known in the art such as nitrogen cooling, cool water jacketing of the equipment, addition of solid $CO_2$, and the like; with a preferred method being solid $CO_2$, and the most preferred method being nitrogen cooling.

A highly attractive opinion in a preferred embodiment of the present invention to further increase the concentration of surfactant in the final particle, is accomplished by the addition to a liquid stream containing the anionic surfactant and/or other surfactant, of other elements that result in increases in viscosity and/or melting point and/or decrease the stickiness of the paste. In a preferred embodiment of the process of the present invention the addition of these elements can be done in line as the paste is pumped into the agglomerator. Example of these elements can be various powders, described in more detail later herein.

Final Agglomerate Composition

The present invention produces granules of high density for use in detergent compositions. A preferred composition of the final agglomerate for incorporation into granular detergents has a high surfactant concentration. By increasing the concentration of surfactant, the particles/agglomerates made by the present invention are more suitable for a variety of different formulations. These high surfactants containing particle agglomerates require fewer finishing techniques to reach the final agglomerates, thus freeing up large amounts of processing aids (inorganic powders, etc.) that can be used in other processing steps of the overall detergent manufacturing process (spray drying, dusting off, etc).

The granules made according to the present invention are large, low dust and free flowing, and preferably have a bulk density of up to about 1.0 g/cc, more preferably from about 0.6 to about 0.8 g/cc. The weight average particle size of the particles of this invention are from about 200 to about 1000 microns. The preferred granules so formed have a particle size range of from 200 to 2000 microns. The more preferred granulation temperatures range from about 10° C. to about 60° C., and most preferably from about 20° C. to about 50° C.

Drying

The desired moisture content of the free flowing granules of this invention can be adjusted to levels adequate for the intended application by drying in conventional powder drying equipment such as fluid bed dryers. If a hot air fluid bed dryer is used, care must be exercised to avoid degradation of heat sensitive components of the granules. It is also advantageous to have a cooling step prior to large scale storage. This step can also be done in a conventional fluid bed operated with cool air. The drying/cooling of the agglomerates can also be done in any other equipment suitable for powder drying such as rotary dryers, etc.

For detergent applications, the final moisture of the agglomerates needs to be maintained below levels at which the agglomerates can be stored and transported in bulk. The exact moisture level depends on the composition of the agglomerate but is typically achieved at levels of 1–8% free water (i.e. water not associated to any crystalline species in the agglomerate) and most typically at 1–4%.

Detergency Builders and Powders

Any compatible detergency builder or combination of builders or powder can be used in the process and compositions of the present invention.

The detergent compositions herein can contain crystalline aluminosilicate ion exchange material of the formula $$Na_z[(AlO_2)_z.(SiO_2)_y].xH_2O$$

wherein z and y are at least about 6, the molar ratio of z to y is from about 1.0 to about 0.4 and z is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate. Hydrated sodium Zeolite A with a particle size of from about 1 to 10 microns is preferred.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter by weight of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange of at least about 50 mg eq. $CaCO_3$/g (12 mg $Mg^{++}$/g) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally occurring aluminosilicates or synthetically derived. A method for producing aluminosilicate ion exchange materials is discussed in U.S. Pat. No. 3,985,669, Krummel et al., issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material has the formula $$Na_{12}[(AlO_2)_{12}(SiO2)_{12}].xH_2O$$

wherein x is from about 20 to about 30, especially about 27 and has a particle size generally less than about 5 microns.

The granular detergents of the present invention can contain neutral or alkaline salts which have a pH in solution of seven or greater, and can be either organic or inorganic in nature. The builder salt assists in providing the desired density and bulk to the detergent granules herein. While some of the salts are inert, many of them also function as detergency builder materials in the laundering solution.

Examples of neutral water-soluble salts include the alkali metal, ammonium or substituted ammonium chlorides, fluorides and sulfates. The alkali metal, and especially sodium, salts of the above are preferred. Sodium sulfate is typically used in detergent granules and is a particularly preferred salt. Citric acid and, in general, any other organic or inorganic acid may be incorporated into the granular detergents of the present invention as long as it is chemically compatible with the rest of the agglomerate composition.

Other useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, and polyhyroxysulfonates. Preferred are the alkali metal, especially sodium, salts of the above.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, incorporated herein by reference.

Examples of nonphosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4. The compositions made by the process of the present invention does not require excess carbonate for processing, and preferably does not contain over 2% finely divided calcium carbonate as disclosed in U.S. Pat. No. 4,196,093, Clarke et al., issued Apr. 1, 1980, and is preferably free of the latter.

As mentioned above powders normally used in detergents such as zeolite, carbonate, silica, silicate, citrate, phosphate, perborate, etc. and process acids such as starch, can be used in preferred embodiments of the present invention.

Polymers

Also useful are various organic polymers, some of which also may function as builders to improve detergency. Included among such polymers may be mentioned sodium carboxy-lower alkyl celluloses, sodium lower alkyl celluloses and sodium hydroxy-lower alkyl celluloses, such as sodium carboxymethyl cellulose, sodium methyl cellulose and sodium hydroxypropyl cellulose, polyvinyl alcohols (which often also include some polyvinyl acetate), polyacrylamides, polyacrylates and various copolymers, such as those of maleic and acrylic acids. Molecular weights for such polymers vary widely but most are within the range of 2,000 to 100,000.

Polymeric polycarboxylate builders are set forth in U.S. Pat. No. 3,308,067, Diehl, issued Mar. 7, 1967. Such materials include the water-soluble salts of homo-and copolymers of aliphatic carboxylic acids such as maleic acid, itaconic acid, mesaconic acid, fumaric acid, aconitic acid, citraconic acid and methylenemalonic acid.

Optionals

Other ingredients commonly used in detergent compositions can be included in the compositions of the present invention. These include flow aids, color speckles, bleaching agents and bleach activators, suds boosters or suds suppressors, antitarnish and anticorrosion agents, soil suspending agents, soil release agents, fillers, germicides, pH adjusting agents, nonbuilder alkalinity sources, hydrotropes, enzymes, enzyme-stabilizing agents, chelating agents and perfumes.

Particulate suds suppressors may also be incorporated either directly in the agglomerates herein by way of the powder stream into the agglomerating unit, or in the finished composition by dry adding. Preferably the suds suppressing activity of these particles is based on fatty acids or silicones.

EXAMPLES

The terms "LAS" and "AS" as used herein mean, respectively, "sodium lauryl benzene sulfonate" and "alkyl sulfate." "MES" means sodium methyl ester sulphonate. The terms like "$C_{45}$" mean $C_{14}$ and $C_{15}$ alkyl, unless otherwise specified. TAS means sodium tallow alkyl sulphate. Dobanol 45E7 is a $C_{14}/C_{15}$ alcohol ethoxylate with 7 units of ethylene oxide and is manufactured by Shell Co. AE3S means sodium alkyl ether sulphate with an average of 3 ethoxy groups per molecule.

High active base granules (agglomerates) were made from a high active surfactant paste and a powder mixture using a small food processor (Braun [TM] Multipractic Plus Electronic de luxe).

The powder mixture consisted of

| | |
|---|---|
| sodium silicate (3 Na) | 11.5% |
| sodium carbonate | 50.5% |
| carboxy methyl cellulose | 1.6% |
| zeolite A | 36.4% |

The high active surfactant paste comprised 18% water, and a total surfactant activity (including optical brightener, when present) of 78%. The anionic surfactants were present in the ratio of 74:24:2 of LAS:TAS:AE3S.

In each experiment, 300 g of this powder mixture were placed inside a mixer bowl and 110.5 g of a the high active paste was added at 50° C. slowly while operating the mixer of the food processor at the highest speed. After about 30 seconds, the cutter speed was reduced to a minimum level and water was slowly added until granulation occurred, resulting in particles with an average diameter between 400 microns and 600 microns. The wet agglomerates were then dried for about 15 minutes in a fluid bed with an air inlet temperature of 60° C. The resulting equivalent relative humidity (eRH) of the agglomerates was 10–15%.

In the following examples 1 to 5, different levels of nonionic surfactant (Dobanol 45E7 [TM] from Shell) and optical brightener (4,4,'-bis-{[2-morpholino-4-anilino- 1,3, 5-triazin-6-yl]amino}stilbene-2,2'-disulphonate)* were processed into the paste before the agglomeration in the food processor. The resulting particles were measured for colour.

* Colour Index Fluorescent Brightener No. 71 as published by the Society of Dyers and Colorists and the American Association of Textile Chemists and Colorists.

| | % Anionic Surfactants in high active paste | % Nonionic Surfactants in high active paste | % Brightener in high active paste |
|---|---|---|---|
| Example 1 | 76.8 | 0 | 1.2 |
| Example 2 | 73.2 | 3.7 | 1.1 |
| Example 3 | 70.0 | 7.0 | 1.0 |
| Comp. Example 4 | 78.0 | 0 | 0 |
| Comp. Example 5 | 70.9 | 7.1 | 0 |

In example 1, the powdered optical brightener was thoroughly mixed for 15 minutes with the high active surfactant paste inside a Drais (TM) kneader (Planetary mixer and kneading machine type FH1.55 from Draiswerke GmbH), kept at 50° C. and with a slight vacuum to avoid aerating the paste.

In examples 3 and 4 the powdered optical brightener was first thoroughly dispersed in the nonionic surfactant at 50° C. using a high speed mixer. This dispersion was then mixed into the high active anionic surfactant paste in the same manner as example 1.

In comparative example 4 the paste was treated in a kneader as in previous examples but no nonionic or brightener was added.

In comparative example 5 the nonionic surfactant was mixed with the anionic surfactant paste in a kneader but no optical brightener was added.

In each example the agglomerates were sieved between Tyler mesh 20 and Tyler mesh 35 to remove the fine and coarse particles, the remaining fraction being assessed for colour by the Hunter Lab method (Hunter, R. S. J.Opt.Soc.Amer 48 597 (1958)) using a commercially available Hunterlab Color/Difference meter model D25-2 from Elscoserv Nev.

The colour readings of the agglomerates were:

| | Hunter Values | | |
|---|---|---|---|
| | L | a | b |
| Example 1 | 92.2 | 0.0 | 5.5 |
| Example 2 | 91.3 | 0.6 | 5.0 |
| Example 3 | 90.8 | 1.2 | 4.6 |
| Comp. Example 4 | 91.8 | −0.4 | 6.9 |
| Comp. Example 5 | 91.2 | −0.4 | 7.6 |

It is known from consumer appearance tests that agglomerates with low L values (<85%), and/or negative a values (a<0) tending to be greenish, and/or high b values (b>6) tending to be yellowish, are easy to pick out from the granular composition and contribute to a poor product appearance.

In this respect examples 1–3 containing optical brightener processed as described, have the best colour. In particular, examples 2 and 3 in which the brightener is premixed with nonionic surfactant have superior colour characteristics.

In examples 6 and 7, agglomerates were made in a Loedige FM mixer/agglomerator.

The powder mixture consisted of:

| | |
|---|---|
| sodium silicate (3 Na) | 17.5% |
| sodium carbonate | 32.5% |
| carboxy methyl cellulose | 2.4% |
| zeolite A | 47.6% |

The high active surfactant paste comprised 18% water, and a total surfactant activity (including dye solution, when present) of 78%. The anionic surfactants were present in the ratio of 74:24:2 of LAS:TAS:AE3S.

In both experiments 25.8 kg of the powder mixture were placed into the mixer/granulator along with 14.3 kg of the high active surfactant paste at 50° C. Both the ploughshares and the choppers of the mixer/agglomerator were operated for about 100 seconds, producing agglomerates with an average particle size of 400–600 microns. The agglomerates were dried in a fluid bed with air inlet temperature of 80° C. for about 15 minutes after which they are cooled down to 35° C. using ambient air before discharge. The eRH of the agglomerates is between 10% and 15%.

In example 6 a dye solution is prepared consisting of: 2 parts of Special Fast Blue G FW Ground (Acid blue 127/1) supplied by Bayer UK Ltd at a concentration of 25%, and 1 part of Levanyl Violet BNZ (Pigment Violet 23) supplied by Bayer UK Ltd at a concentration of 25%.

This dye mixture was then diluted to a 0.1% aqueous solution before mixing with the high active surfactant paste and subsequently processing into agglomerates in the manner described above. 90 ml of the 0.1% solution was mixed with 15 kg of paste.

In each example the agglomerates were sieved between Tyler mesh 20 and Tyler mesh 35 to remove the fine and coarse particles, the remaining fraction being assessed for colour by the Hunter Lab method (Hunter, R. S. J.Opt.Soc. Amer 48 597 (1958)) using a commercially available Hunterlab Color/Difference meter model D25-2 from Elscoserv Nev.

The colour readings of the agglomerates was:

| | Hunter Values | | |
|---|---|---|---|
| | L | a | b |
| Example 6 (with dye) | 87.4 | −0.2 | 4.3 |
| Comp. example 7 (no dye) | 89.6 | −0.5 | 9.4 |

Example 6 (with dye) has less of a yellow colour than example 7 in which no dye has been added.

What is claimed is:

1. A process for making a high active detergent granule comprising the steps of dispersing organic detergent component, with particles of an inorganic component in the presence of a dye, characterized by the steps of:

(i) making a high active detergent paste comprising at least 40% by weight anionic surfactant salts, by neutralization of the corresponding acids, said paste having a viscosity of at least 10 Pa.s when measured at a temperature of 70° C. and a shear rate of 25 $s^{-1}$, said paste composition comprising at least 5% by weight of linear alkyl benzene sulfonate, methylester sulfonate, paraffin sulfonate, or a mixture of these;

(ii) granulating said high active paste to form agglomerates in a high shear mixer/granulator with an effective amount of detergent powders; and (iii) adding a dye, in an amount of from 0.1 to 20 ppm, based on the weight of the high active paste, by mixing the dye with the high active paste in step (i), or by pumping or by spraying the dye into the high shear mixer/granulator in step (ii).

2. A process according to claim 1 wherein the dye is added at step (i) of the process into a loop reactor in which the anionic detergent acids are neutralized to form their salts.

3. A process according to claim 1 wherein the dye is added in liquid form at step (ii) of the process into the high shear mixer/granulator, either as aqueous solution or as a premix with a carrier.

4. A process according to claim 1 wherein the dye is chosen from those dyes which emit at least 70% of light in the region of visible light below a wavelength of 500 nm.

5. A high active detergent paste composition for use as an intermediate in a process for the manufacture of a granular detergent, comprising a dye characterized in that:

said paste composition comprises at least 60% by weight of the salts of anionic surface active agents, and that the paste composition has a viscosity of at least 10 Pa.s to 10.000 Pa.s, when measured at a temperature of 70° C. and a shear rate of 25 $s^{-1}$;

and between 5 and 40% by weight of the paste composition of water; and wherein said dye is present at a level of from 0.1 to 20 ppm based on the weight of the paste composition.

6. A composition according to claim 5, said dye being selected from the group consisting of dyes having a Part I Color Index of Pigment Violet 23 and a Part II Color Index of 51319, dyes having a Part I Color Index of Acid Blue 127/1 and mixtures thereof.

7. A composition according to claim 5, said dye being present at a level of from 0.1 to 5 ppm of the paste composition.

8. A composition according to claim 5 characterised in that the dye is added to the composition in the form of an aqueous solution.

* * * * *